US005182840A

United States Patent [19]

Jacobs et al.

[11] Patent Number: 5,182,840

[45] Date of Patent: Feb. 2, 1993

[54] EPOXY FLOOR ROLLER TOOL AND METHOD OF MAKING SAME

[75] Inventors: William A. Jacobs, Wooster; William P. Camp, Jr., Millersburg, both of Ohio

[73] Assignee: The Wooster Brush Company, Wooster, Ohio

[21] Appl. No.: 810,105

[22] Filed: Dec. 19, 1991

[51] Int. Cl.[5] ..... B30B 3/00

[52] U.S. Cl. ..... 492/24; 118/600; 118/612; 492/37; 492/43; 492/45; 492/47

[58] Field of Search ..... 29/121.1, 121.4, 121.5, 29/121.6, 121.7, 121.8, 123, 128, 130, 131, 132

[56] References Cited

U.S. PATENT DOCUMENTS

| | | | |
|---|---|---|---|
| 241,644 | 5/1881 | Gifford | 29/121.4 X |
| 364,817 | 6/1887 | Gessner . | |
| 843,138 | 6/1905 | Dunning | 29/121.4 X |
| 878,348 | 2/1908 | Gobbett | 29/121.4 X |
| 944,031 | 12/1909 | Gillet . | |
| 1,015,202 | 1/1912 | Moore et al. . | |
| 1,957,732 | 5/1934 | Rowe . | |
| 2,023,032 | 12/1935 | Rooney | 29/121.1 X |
| 2,186,771 | 1/1940 | Smith . | |
| 2,605,488 | 8/1952 | Bugg | 29/121.4 X |
| 3,112,505 | 12/1963 | Hirst | 29/121.1 X |
| 4,196,496 | 4/1980 | Stauffer et al. | 29/121.1 X |

*Primary Examiner*—Timothy V. Eley
*Assistant Examiner*—C. Martin
*Attorney, Agent, or Firm*—Renner, Otto, Boisselle & Sklar

[57] ABSTRACT

An epoxy floor roller tool formed by spirally winding a continuous strip of carding cloth having wires protruding outwardly therefrom around a roller core tube. The carding cloth wires are made of a cadmium plated steel which allows the wires to remain rigid even though quite thin and densely packed, whereby when the roller tool is rolled against a wet epoxy material spread over a floor surface, the wires will break even very small, closely spaced air bubbles in the epoxy, allowing the air to be released so that the voids caused by the air bubbles will flow closed without cratering before the epoxy hardens.

11 Claims, 2 Drawing Sheets

EPOXY FLOOR ROLLER TOOL AND METHOD OF MAKING SAME

FIELD OF THE INVENTION

The present invention relates generally to an epoxy floor roller tool for removing undesirable air bubbles from epoxy floor materials before the epoxy hardens on the floor. Also, this invention relates to the method of making such a roller tool.

BACKGROUND OF THE INVENTION

Epoxy floors are gaining widespread use in a number of industries such as food, pharmaceutical and nuclear power. The two part epoxies used are specifically designed to give a glass-smooth finish coat to concrete floors. This eliminates unwanted pockets such as found in rough concrete floors where undesirable debris can collect, and makes cleanup of the floors much easier.

During the mixing or agitation of the epoxy floor material, air becomes entrapped in the epoxy. Also, air is introduced into the epoxy during pouring and spreading of the epoxy onto the floor. Concrete surfaces are by nature porous, which also adds to the amount of air trapped in the epoxy material during the spreading of the epoxy material onto the floor. Moreover, atmospheric pressure changes are a large contributor of gas bubbles in epoxy (as well as polyurethane) floor materials. The entrapped air forms various sized air bubbles which naturally rise to the surface of the epoxy material, but will not normally escape due to surface tension. When the epoxy material hardens, the air bubbles at the surface are micro thin and can easily be broken, leaving behind craters or pockets where undesirable debris can collect. Thus, there is a need for an effective tool to break both the surface bubbles and the air bubbles still suspended in the wet epoxy so that the voids caused by the air bubbles will flow closed without cratering before the epoxy hardens.

The same need exists for polyurethane floor materials which are also used to give a glass-smooth finish to concrete floors. Thus, while epoxy floor materials are specifically discussed, it should be understood that the same tool can similarly be used to eliminate air bubbles from polyurethane and other such floor materials as well.

Currently plastic injection molded spiked rollers are used to break the air bubbles and allow the air to be released from the epoxy while the epoxy is still wet. However, the spikes of these injection molded rollers are not very dense, whereby such rollers are not very effective in breaking the air bubbles even after repeated rolling of the surface. Also, the spikes of such plastic injection molded rollers are of a relatively large diameter, whereby they produce a relatively large footprint in the wet epoxy which doesn't self-level very well especially as the epoxy material starts to harden. Furthermore, such plastic injection molded rollers are not very rigid or durable and tend to wear out fairly quickly.

SUMMARY OF THE INVENTION

The present invention is for an epoxy floor roller tool that is much more effective in breaking air bubbles in epoxy floor materials (as well as polyurethane floor materials and the like) than the existing plastic injection molded spiked rollers. Also, the roller tool of the present invention is much more rigid and durable than existing plastic spiked rollers, and holds up much better during use for longer life.

In accordance with one aspect of the invention, the epoxy floor roller tool is formed by spirally winding a continuous strip of carding cloth having wires protruding outwardly therefrom around a roller core tube. The wires that extend radially outwardly from the carding cloth backing are quite thin and densely packed, whereby when the roller tool is rolled against the still wet epoxy material, the wires will break even very small, closely spaced bubbles allowing the air to be released. Also, the wires, being relatively thin, leave a relatively small footprint in the wet epoxy material which self-levels more readily even as the epoxy material starts to harden.

In accordance with another aspect of the invention, the roller wires are desirably made of cadmium plated steel for increased rigidity and durability and to prevent the wires from corroding under high humidity conditions.

In accordance with still another aspect of the invention, a plurality of such roller tools are desirably made by helically winding carding cloth having the desired type and density of wires protruding from one side thereof around roller core tubes more than several lengths longer than the final desired roller tool tube length. The carding cloth is a continuous strip which is cut into lengths sufficient to cover the longer roller core tubes when spirally wound thereon. Preferably before cutting the carding cloth to length, the protruding wires are removed from approximately the first inch or so of the leading section of carding cloth and also from about a two inch or so section after each desired length of carding cloth. Then the carding cloth is cut approximately through the middle of each two inch section, leaving lengths of carding cloth with approximately one inch sections without wires at each end. This provides sufficient room to permit the leading section of each strip of carding cloth to be stapled to one end of a roller core tube, and after the carding cloth has been completely wound onto the tube, also permits the trailing section to be stapled to the other end of the tube.

Further in accordance with the invention, an epoxy adhesive is applied to the length of the longer roller core tubes prior to helically winding the strips of carding cloth around the tubes. After the adhesive cures, the longer tubes are cut into a plurality of shorter tubes of the desired roller tool lengths. Then any loose or broken wires are removed from both ends of each cut tube, and end caps are inserted into the tube ends and stapled in place from the outside, thus mechanically locking the carding cloth, tube and end caps together. Sufficient wires are removed from the ends of the cut tubes prior to stapling the end caps in place to provide enough clearance space for the staples without damaging the remaining wires.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

Figure 6:
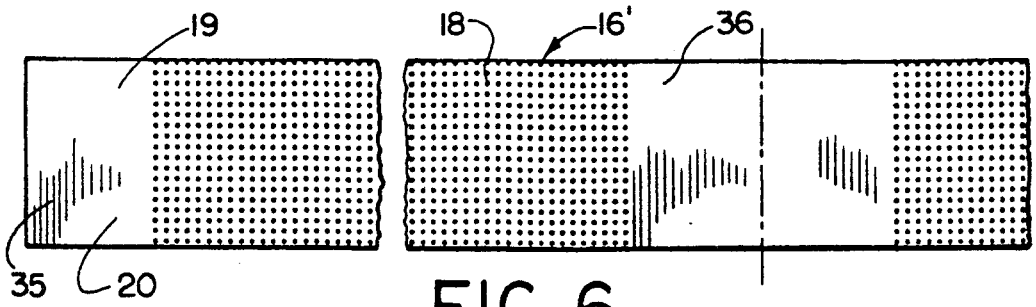
FIG. 6 is an enlarged schematic top plan view of a continuous strip of carding cloth having sections from which the wires have been removed.
Figure 7A:
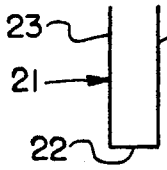
FIG. 7 is a schematic side elevation view of the strip of carding cloth shown in FIG. 6.
Figure 7:
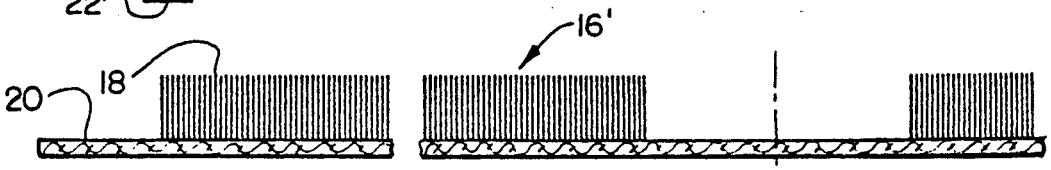
Figure 8:
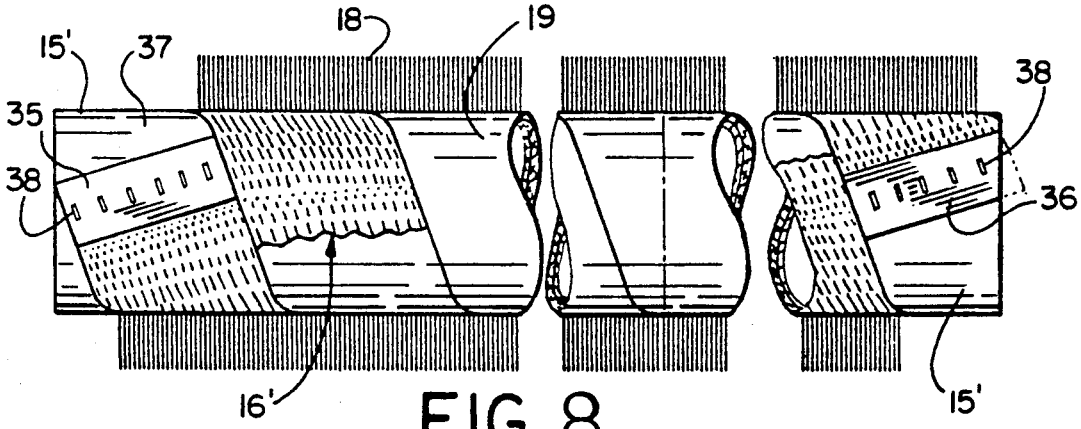
Figure 9:
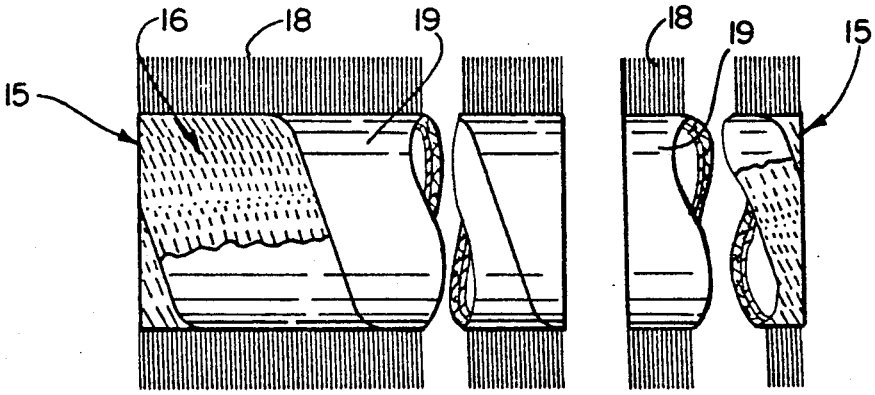

FIG. *7a* is an enlarged elevation view of one of the wire members that has been removed from the carding cloth of FIGS. 6 and 7;

FIG. 8 is a schematic illustration showing a portion of the carding cloth of FIGS. 6 and 7 spirally wrapped around an elongated roller core tube with the end sections of the carding cloth from which wires have been removed stapled to the ends of the tube; and FIG. 9 is a schematic illustration showing the elongated roller core tube of FIG. 8 cut up into a plurality of shorter tube lengths.

DETAILED DESCRIPTION OF THE PREFERRED EMBODIMENT

Figure 1:
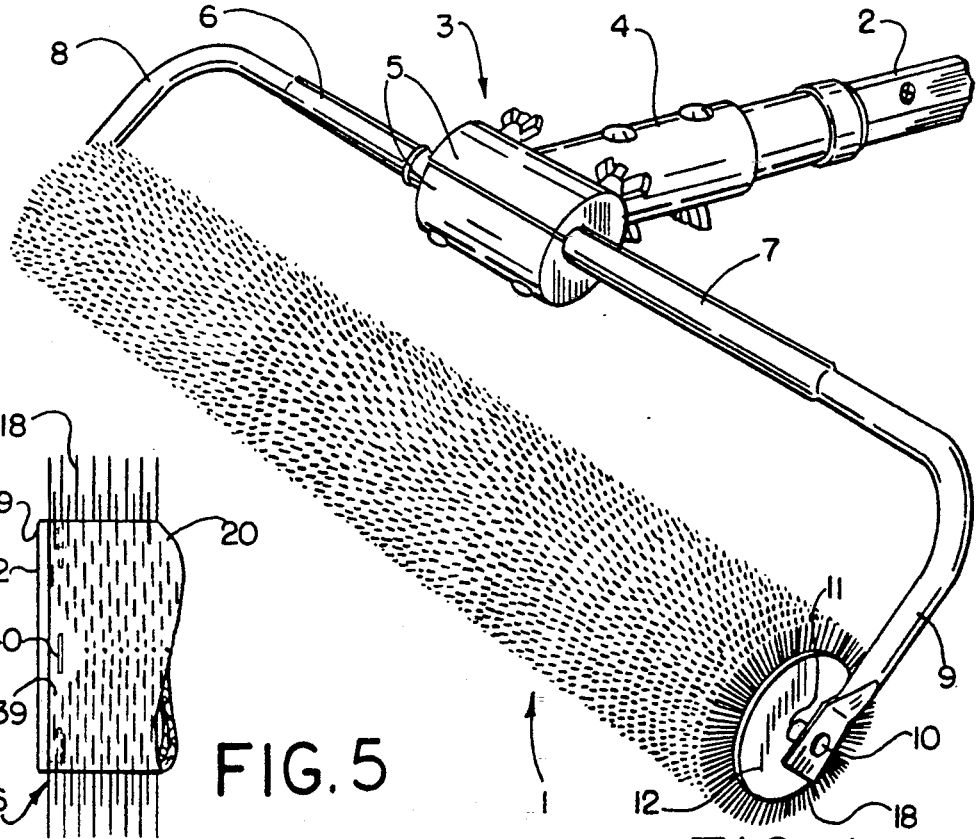
FIG. 1 is a perspective view of a preferred form of epoxy floor roller tool in accordance with this invention shown attached to a conventional roller frame.
Figure 5:
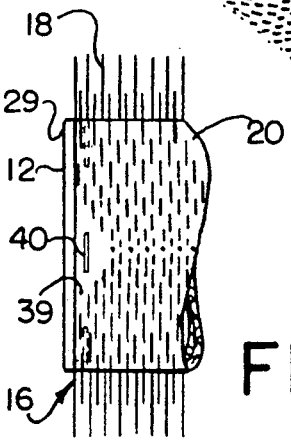
FIG. 5 is an enlarged top plan view of one end of the roller tool of FIG. 2 as generally seen from the plane of the line 5—5 thereof.
Figure 2:
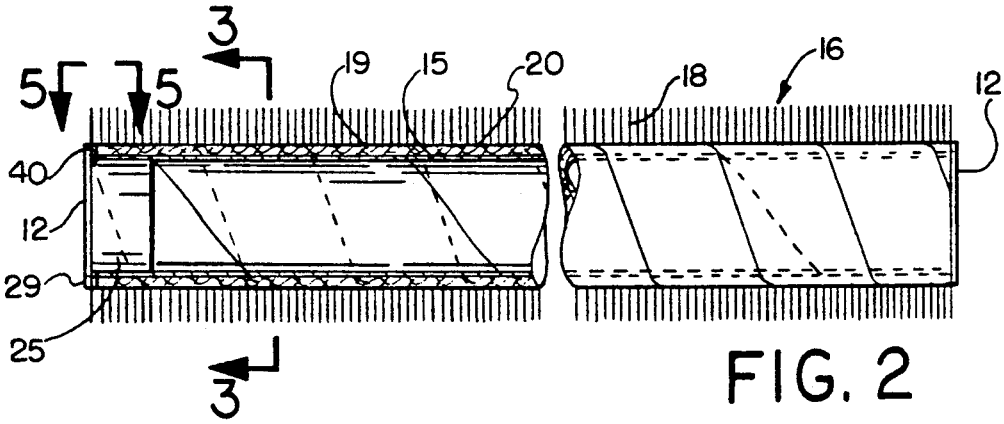
FIG. 2 is a fragmentary longitudinal section through the roller tool of FIG. 1.

Referring now in detail to the drawings, and initially to FIG. 1, there is shown a preferred form of epoxy floor roller tool 1 in accordance with this invention connected to a handle 2 by means of an adjustable roller frame 3 which may be of the type disclosed, for example, in U.S. Pat. No. 4,868,946, assigned to the same assignee as the present application and incorporated herein by reference. The roller frame 3 includes a support member 4 and associated clamp members 5 for supporting a pair of rod-like support arms 6, 7 for axial sliding movement in opposite directions toward and away from each other. The distal ends 8, 9 of the support arms 6, 7 are bent so as to be substantially parallel to each other and have stub shafts 10 protruding therefrom in substantial coaxial alignment for receipt in holes 11 in end caps 12 at the ends of the roller tool 1 for rotatably supporting the roller tool on the roller frame.

Roller tool 1 may be of any desired length, for example, eighteen inches, and includes a roller core tube 15 (see FIG. 2) preferably made of impregnated paper or plastic. The roller core tube 15 desirably has an outer diameter of approximately one and one-half inches. Spirally wrapped around the tube 15 is a continuous strip of carding cloth 16 having wires 18 protruding radially outwardly therefrom as schematically shown in FIGS. 1 through 3 and 5. The wires 18 are quite thin and densely packed, whereby when the roller tool 1 is rolled over a wet coating of epoxy material spread over a floor, such wires will break even very small closely spaced air bubbles in the epoxy coating allowing the air to be released. Also, the footprint in the wet epoxy caused by the thin wires is relatively small and will self-level more readily even as the epoxy material starts to harden.

In the preferred embodiment disclosed herein, the carding cloth 16 includes a continuous backing strip 19 made of a tightly woven fabric having a width of approximately one and one-half inches and a thickness of approximately one-eighth inch. On the front or outer side of the fabric backing strip 19 is a rubber-like coating 20 to prevent any loose fabric or dust from coming out through the backing material.

The carding cloth 16 is made by pressing a multitude of generally U-shaped wire members 21 (one of which is schematically shown in FIG. *7a* on an enlarged scale) through the backing material 19 from the back side until the cross piece 22 of each wire member engages the back side of the backing material and the two legs 23 protrude perpendicularly outwardly beyond the rubber-like coating 20 on the front side to form the wires 18. Each wire member 21 desirably has a diameter of approximately 0.016 inch. Also, each leg member 23 desirably has a total length of approximately 0.525 inch, leaving a free length of wire 18 extending outwardly beyond the backing material 19 of approximately 0.400 inch. Moreover, each cross member 22 desirably has a length of approximately 0.210 inch, thus providing a spacing of approximately that amount between each pair of leg members 23.

The density of the wires 18 protruding from the cloth backing 19 can be varied by varying the number, position and spacing of the wire members 21. Preferably, the wires 18 are as dense as possible to maximize the number of air bubbles in the wet epoxy material that are punctured during a single pass of the roller tool without causing the epoxy material to form a bridge between the wires and be picked up by the roller tool.

Figure 3:
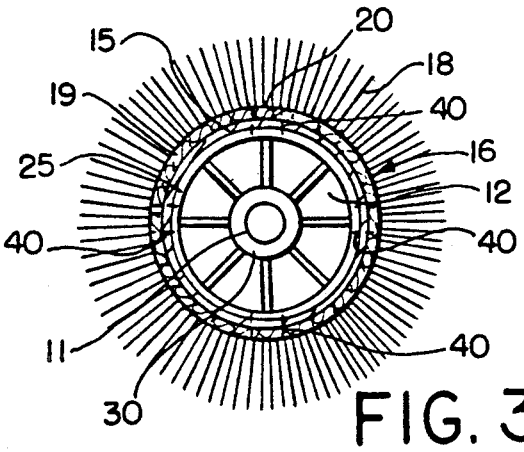
FIG. 3 is an enlarged transverse section through the roller tool of FIG. 2, taken generally along the plane of the line 3—3 thereof.

The density of the wires 18 will of course be greater adjacent the outer surface of the cloth backing 19 than at the outer ends thereof when the carding cloth is spirally wound around the roller core tube 15. In the preferred embodiment disclosed herein, the density of the wires 18 while the carding cloth 16 is laying substantially flat as shown in FIGS. 6 and 7 is desirably approximately 170 wires per square inch. However, after the carding cloth 16 has been spirally wound around a one and one-half inch diameter roller core tube 15, the wires 18 will flare out as schematically shown in FIGS. 1 and 3, which reduces the density of the wires at their tips to approximately 110 wires per square inch.

To give the wires 18 the desired rigidity during use of the roller tool 1, and to prevent the wires from corroding under high humidity conditions, the wires are desirably made of a cadmium plated steel. Also, the durability of the roller tool 1 is increased both by adhesively bonding the carding cloth backing 19 and wire cross members 22 to the outer surface of the roller core tube 15 and mechanically locking the carding cloth 16, roller core tube 15 and end caps 12 together as described hereafter.

Figure 4:
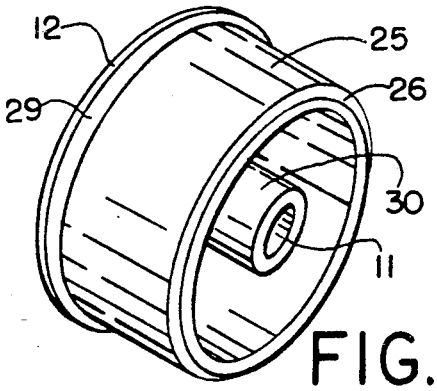
FIG. 4 is an enlarged perspective view of one of the end caps for the roller tool.

One of the end caps 12 is shown in FIG. 4 prior to insertion into one end of the tube 15, and includes a cylindrical wall portion 25 having a slight bevel 26 on the axial inner end thereof to facilitate insertion into the open ends of the roller core tube 15. At the axial outer end of the cylindrical wall portion 25 is a relatively thin radial end flange 29 having a thickness of approximately 0.0625 inch. Flange 29 radially overlaps the ends of the roller core tube 15 and carding cloth backing 19 to conceal such ends and locate the end caps in place. Centrally of the end flange 29 is a coaxially inwardly extending bushing 30 containing the hole 11 for the stub shaft 10.

To make epoxy floor roller tools 1 in accordance with the present invention, impregnated paper or plastic roller core tubes 15' several times the length of the final desired roller core tube length are desirably used in the manufacturing process. For example, when the final desired length of each roller core tube 15 is eighteen inches, the longer roller core tubes used in the manufacturing process desirably have a length somewhat greater than three times that length, for example, fifty-six inches, for making three such roller tools. Also, the carding cloth 16' that is used in the manufacturing process is a continuous strip which is cut into lengths sufficient to cover the longer core tube lengths when spirally wound thereon.

Before the carding cloth 16' is cut to the desired length, the wires 18 are preferably removed from approximately the first inch or so of the leading section 35 of the carding cloth and also from about a two inch or so section 36 after each desired length as schematically shown in FIGS. 6 and 7. Then the carding cloth 16 is cut approximately through the middle of each two inch section 36 to provide plural lengths of carding cloth each having approximately one inch sections 35, 36 without wires at each end for a purpose to be subsequently described.

The longer roller core tube 15' is placed on a lathe type spiraling machine and an epoxy adhesive 37 is applied to the entire length of the tube as schematically shown in FIG. 8. Then the leading section of the cut length of carding cloth 16' (the approximately one inch section 35 at one end having backing 19 only without wires 18) is stapled to one end of the longer tube 15' using staples 38, and the tube is rotated to cause the carding cloth to be helically wound around the tube at approximately a 37° angle from the perpendicular, with no gaps or overlaps in the carding cloth.

After the length of carding cloth has been completely wound on the longer tube, the tail end section 36 (the one inch section at the other end having backing only without wires) is stapled to the other end of the tube using staples 38. Then the longer tube 15' is removed from the spiraling machine and the adhesive is allowed to air dry overnight. Also, the adhesive may be given a final cure in an oven at 180° F. for approximately fifteen minutes.

After the curing step, a cross cut is made at one end of the longer tube 15' using an abrasive wheel saw to completely remove the leading section 35 of carding cloth as schematically shown in FIG. 9. Then additional cross cuts are made to cut the longer tube 15' into shorter tubes 15 of the final desired lengths, for example, eighteen inch lengths.

Next the inside ends of the shorter tubes 15 may be hand scraped with a knife to eliminate any burrs if present. Also, any loose or broken wires 18 are removed from the tube ends with a suitable tool such as a needle nose pliers to prevent any loose wires from falling out into the epoxy floor coating during use of the roller tool and to provide sufficient clearance areas 39 at the ends of the tubes for stapling of the end caps 12 in the ends of the tubes (see FIG. 5).

A minimum of four staples 40 are desirably used to secure each end cap 12 in place. Preferably the end caps 12 are made of a mixture containing 50% high density polyethylene and 50% low density polyethylene to better take the staples 40. The staples 40 may be inserted by hand using a pneumatic staple gun which has a narrow head, thus allowing the staples to be inserted in the cleared areas 39 at the ends of the tubes 15 without damaging any of the remaining wires 18. The staples 40 are of sufficient length to penetrate the carding cloth backing 19, roller core tube 15 and plastic end cap side walls 25 (see FIGS. 2 and 3), thus mechanically locking the carding cloth, roller core tube and end caps together. Finally, the roller tools 1 are vacuumed and blown off with compressed air to remove any dust or lint and suitably packaged for shipping and handling prior to use.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. An epoxy floor roller tool comprising a roller core tube, a continuous strip of carding cloth spirally wound around said tune with each succeeding winding of said carding cloth in butting engagement with a preceding winding, and end caps closing the ends of said tube, said carding cloth covering the entire length of said tube, said carding cloth having a fabric backing member, and rigid, densely packed, thin metal wires extending radially outwardly from said backing member over the entire length of said tube for use in breaking air bubbles in epoxy and polyurethane floor materials after the floor materials have been spread over a floor and before the floor materials have hardened, said wires comprising leg members of generally U-shape wire members extending through said backing member, said wire members having cross members pressed up against a back side of said backing member, said backing member and said cross members being adhesively bonded to said tube.

2. The tool of claim 1 wherein said tube has an outer diameter of approximately one and one-half inches, and said wires are made of cadmium plated steel having a diameter of approximately 0.016 inch and a free length extending outwardly beyond said backing member of approximately 0.400 inch.

3. The tool of claim 1 wherein said backing member is made of a strip of tightly woven cloth having a rubber-like coating on an outer side of said strip, and said wires extend completely through said backing member and radially outwardly beyond said rubber-like coating.

4. The tool of claim 3 wherein said strip is approximately one and one-half inches wide and said tube has an outer diameter of approximately one and one-half inches and a length of approximately eighteen inches, and said wires extend outwardly beyond said rubber-like coating a distance of approximately 0.400 inch.

5. The tool of claim 1 wherein said backing member has a thickness of approximately 0.250 inch, and said leg members have a diameter of approximately 0.016 inch and an overall length of approximately 0.650 inch, whereby said leg members extend radially outwardly beyond said backing member a distance of approximately 0.400 inch.

6. The tool of claim 5 wherein said cross members have a length of approximately 0.210 inch.

7. The tool of claim 1 wherein each of said end caps has a cylindrical wall portion extending into the respective ends of said tube, said end caps being secured within the ends of said tube by staples extending through said backing member, said tube, and said cylindrical wall portion of each of said end caps.

8. The tool of claim 7 wherein said end caps are made of a plastic containing 50% high density polyethylene and 50% low density polyethylene.

9. The tool of claim 7 wherein each of said end caps has a radial flange at an outer end of said cylindrical wall portion radially overlapping opposite ends of said roller core tube and said fabric backing member, said wires extending radially outwardly beyond said radial flange of each of said end caps.

10. The tool of claim 1 wherein said end caps have cylindrical wall portions extending into the respective ends of said tube, said end caps being secured within said ends of said tube by staples extending through said backing member, said tube, and said cylindrical wall portions of said end caps, said carding cloth only being wireless where said staples extend through said backing member to provide sufficient clearance space for inserting said staples without damaging said wires which extend radially outwardly from the ends of said backing member at the ends of said tube.

11. An epoxy floor roller tool comprising a roller core tube, a continuous strip of carding cloth spirally wound around said tube with each succeeding winding of said carding cloth in butting engagement with a preceding winding, and end caps closing the ends of said tube, said carding cloth having a fabric backing member, and rigid, densely packed, thin metal wires extending radially outwardly from said backing member for use in breaking air bubbles in epoxy and polyurethane floor materials after the floor materials have been spread over a floor and before the floor materials have hardened, said end caps having cylindrical wall portions extending into ther respective ends of said tube, said end caps being secured within said ends of said tube by staples extending through said backing member, said tube, and said cylindrical wall portions of said end caps.

* * * * *